US009908341B2

(12) United States Patent
Akahori et al.

(10) Patent No.: US 9,908,341 B2
(45) Date of Patent: Mar. 6, 2018

(54) PRINTING APPARATUS AND PRINTING METHOD

(71) Applicant: CANON FINETECH INC., Misato-shi (JP)

(72) Inventors: Shizuka Akahori, Nagareyama (JP); Kazuki Sakamoto, Tokyo (JP); Noritaka Nakashima, Yashio (JP)

(73) Assignee: Canon Finetech Nisca, Inc., Misato-shi (JP)

( * ) Notice: Subject to any disclaimer, the term of this patent is extended or adjusted under 35 U.S.C. 154(b) by 0 days.

(21) Appl. No.: 14/668,188

(22) Filed: Mar. 25, 2015

(65) Prior Publication Data

US 2015/0273882 A1 Oct. 1, 2015

(30) Foreign Application Priority Data

Mar. 26, 2014 (JP) ..... 2014-064375

(51) Int. Cl.
*B41J 2/01* (2006.01)
*B41J 11/00* (2006.01)
(Continued)

(52) U.S. Cl.
CPC ..... *B41J 11/0015* (2013.01); *B41J 2/16508* (2013.01); *B41J 2/16511* (2013.01);
(Continued)

(58) Field of Classification Search
USPC ..... 347/5, 9, 22, 16, 102, 104
See application file for complete search history.

(56) References Cited

U.S. PATENT DOCUMENTS 7,158,243 B2 1/2007 Sakamoto et al.
7,773,244 B2 8/2010 Yano et al.
(Continued)

FOREIGN PATENT DOCUMENTS

JP 08-323987 A 10/1996
JP 2007-268749 A 10/2007
(Continued)

OTHER PUBLICATIONS

Japanese Office Action dated May 30, 2017 in Japanese Patent Application No. 2014-064375.
(Continued)

*Primary Examiner* — Lam Nguyen
(74) *Attorney, Agent, or Firm* — Fitzpatrick, Cella, Harper & Scinto

(57) ABSTRACT

The present invention intends to provide a printing apparatus that can lessen a reduction in ejection performance caused by thickening, solidification, or the like of print liquid in an ejection port of a printing unit even in the case of stopping a print operation by the printing unit to perform a post-process on a print medium. The printing apparatus includes a post-processing part configured to, in a state of stopping the print operation by the printing unit, perform the post-process on a printed print medium as well as including an open/close unit configured to selectively perform a closing operation or an opening operation of the ejection port provided in the printing unit. Further, when the print medium is stopped in the post-processing part, the open/close unit is controlled so as to bring the ejection port into a close state.

14 Claims, 9 Drawing Sheets

(51) Int. Cl.
*B41J 2/165* (2006.01)
*B41J 3/407* (2006.01)

(52) U.S. Cl.
CPC ..... *B41J 2/16585* (2013.01); *B41J 3/4075* (2013.01); *B41J 2002/16573* (2013.01); *B41J 2002/16591* (2013.01)

(56) References Cited

U.S. PATENT DOCUMENTS

| | | | | |
|---|---|---|---|---|
| 7,880,910 | B2 | 2/2011 | Aichi et al. | |
| 8,174,711 | B2 | 5/2012 | Yano et al. | |
| 8,619,270 | B2 * | 12/2013 | Fukasawa | B41J 3/60 347/16 |
| 8,733,882 | B2 | 5/2014 | Yudasaka et al. | |
| 2003/0222985 | A1 | 12/2003 | Goto et al. | |
| 2009/0315963 | A1 * | 12/2009 | Sakata | B41J 11/002 347/102 |
| 2010/0225683 | A1 | 9/2010 | Yamashiro | |
| 2012/0236061 | A1 | 9/2012 | Yudasaka et al. | |
| 2014/0028771 | A1 | 1/2014 | Yamada et al. | |

FOREIGN PATENT DOCUMENTS

| | | | |
|---|---|---|---|
| JP | 2008-068596 | A | 3/2008 |
| JP | 2012-192555 | A | 11/2012 |

OTHER PUBLICATIONS

Japanese Office Action dated Oct. 31, 2016 issued in corresponding Japanese Patent Application No. 2014-064375.

* cited by examiner

| NUMBER OF LABELS | ACQUISITION TIME T[s] | MEDIAN Tc[s] |
|---|---|---|
| 1 | 2.9 | 5 |
| 2 | 3.3 | 5 |
| 3 | 2.7 | 5 |
| 4 | 3.2 | 2.9 |
| 5 | 3 | 3.2 |
| 6 | 19.8 | 3 |
| 7 | 2.8 | 3.2 |
| 8 | 2.7 | 3 |
| 9 | 3 | 2.8 |
| 10 | 3.2 | 2.8 |
| 11 | 2.8 | 3 |
| 12 | 25.6 | 3 |
| 13 | 3.1 | 3.2 |
| 14 | 2.8 | 3.1 |

| NUMBER OF LABELS | ACQUISITION TIME T[s] | MEDIAN Tc[s] |
|---|---|---|
| 1 | 11.8 | 5 |
| 2 | 11.5 | 5 |
| 3 | 12 | 5 |
| 4 | 12.1 | 11.8 |
| 5 | 11.9 | 12 |
| 6 | 12.2 | 12 |
| 7 | 11.7 | 12.1 |
| 8 | 12 | 11.9 |
| 9 | 12.3 | 12 |
| 10 | 12.4 | 12 |
| 11 | 12.2 | 12.3 |
| 12 | 12.5 | 12.3 |
| 13 | 11.9 | 12.4 |
| 14 | 11.5 | 12.2 |

| FIG.8A |
| --- |
| FIG.8B |

PRINTING APPARATUS AND PRINTING METHOD

BACKGROUND OF THE INVENTION

Field of the Invention

The present invention relates to a printing apparatus and printing method that print on a print medium using a print head capable of ejecting print liquid toward the print medium.

Description of the Related Art

In a printing apparatus that performs printing by ejecting print liquid containing color material from ejection ports arrayed in a print head, keeping liquid ejection performance of the ejection ports in an adequate state is important for keeping the quality of a printed image good. For this purpose, in a conventional printing apparatus, capping that after the completion of a print operation, covers a surface where ejection ports of a print head are formed (ejection port surface) with a capping member is performed. The capping makes it possible to reduce damage to the ejection port surface and thickening/solidification of print liquid associated with the evaporation of a solvent in the print liquid to keep ejection performance of the ejection ports.

As a printing apparatus that performs printing using a print head, Japanese Patent Laid-Open No. H08-323987 (1996) discloses a printing apparatus that uses a print head to print on the plurality of labels affixed on a long mount. Also, among current printing apparatuses, there is one in which on the downstream side of a print head, a post-processing part that performs a predetermined process on a printed print medium or the like is arranged. For example, among printing apparatuses that use a print head to print on labels, there is known one that includes a post-processing part that performs a peeling process to peel off a printed label from a mount or performs a cutting process of each label.

SUMMARY OF THE INVENTION

A first aspect of the present invention is a printing apparatus that prints on a print medium with use of a printing unit in which an ejection port capable of ejecting print liquid is formed, and the printing apparatus includes: a post-processing part configured to perform a predetermined post-process, which is different from a process for a print operation, on the print medium which has been printed by the printing unit; an open/close unit configured to be capable of selectively bringing the ejection port into a close state or an open state; and a control unit configured to, in response to a state where the print medium is subjected to the post-process of the post-processing part, control the open/close unit so as to bring the ejection port into the close state.

Also, a second aspect of the present invention is a printing method that prints on a print medium with use of a printing unit in which an ejection port capable of ejecting print liquid is formed, and the printing method includes: a post-processing step of, in a state where a print operation by the printing unit is stopped, performing a predetermined post-process on the print medium which has been printed by the printing unit; an open/close step of selectively bringing the ejection port into a close state or an open state; and a control step of, when the print medium is stopped in the post-processing part, controlling an open/close unit so as to bring the ejection port into the close state.

Further features of the present invention will become apparent from the following description of exemplary embodiments (with reference to the attached drawings).

DESCRIPTION OF THE EMBODIMENTS

Embodiments of the present invention will hereinafter be described in detail with reference to the drawings.

First Embodiment

Figure 1:
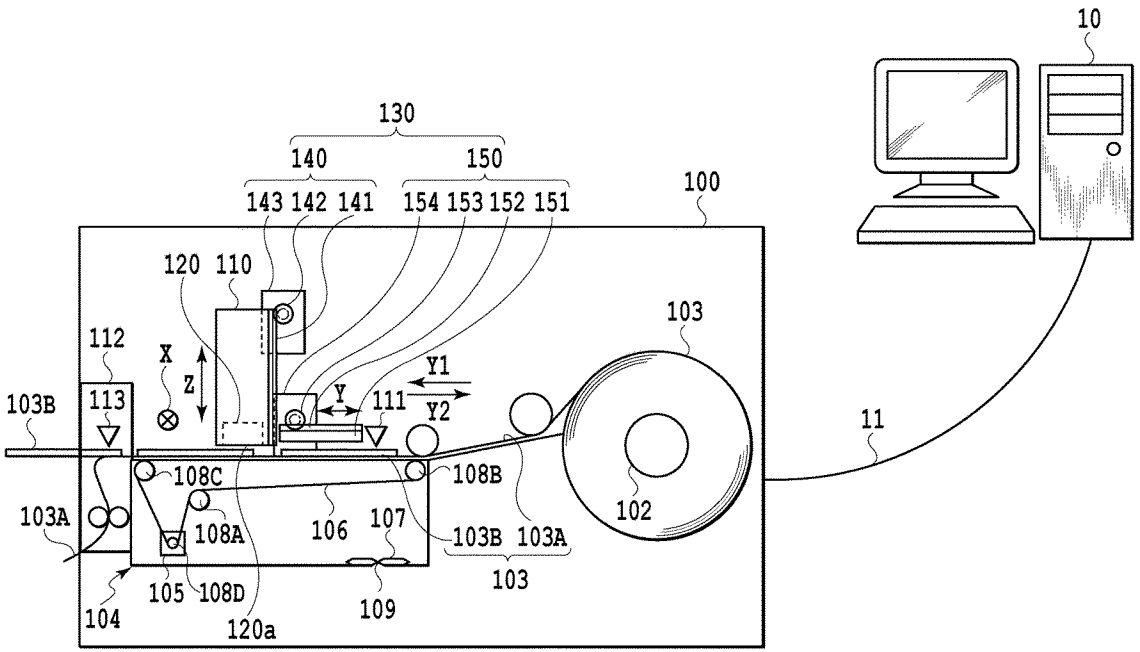
FIG. 1 is an explanatory diagram illustrating a schematic configuration of a printing system in embodiments of the present invention.

FIG. 1 is an explanatory diagram illustrating a schematic configuration of a printing system that includes a printing apparatus 100 in the present embodiment and a host computer (host device) 10 connected to the printing apparatus 100. The host computer 10 outputs print data to be printed by the printing apparatus 100, information on a cutting position or a print medium, or the like to the printing apparatus 100 as a control command through a printer cable 11.

The printing apparatus 100 in the present embodiment uses a continuous sheet wound in a roll shape as a print medium 103. The print medium 103 configured to include: a belt-like-shaped long mount 103A and a plurality of labels 103B affixed on the mount 103A in a peelable manner along the longer direction. Also, the roll-shaped print medium 103 is held by a medium supply part 102 provided in the printing apparatus 100, and conveyed in a conveyance direction (Y direction) by below-described conveyance unit. The conveyance unit in the present embodiment is adapted to be able to convey the print medium 103 not only in a forward conveyance direction (Y1 direction) but also in a backward conveyance direction (Y2 direction) that is a direction opposite to the forward conveyance direction. The print medium 103 conveyed in the forward conveyance direction (Y1 direction) from the print medium supply part 102 is given print liquid by a printing part 110 and printed with an image, and then a part of a printed label 103B is peeled off from the mount 103A by a peeling part 112.

In a conveyance unit 104 included in the print medium conveyance unit, a conveyance motor 105, conveyance belt 106, and suction fan 107 are provided. The conveyance belt 106 is built between guide rollers 108A, 108B, and 108C and a driving roller 108D. Driving force of the conveyance motor 105 rotates the driving roller 108D, and thereby the conveyance belt 106 moves in the forward conveyance direction (Y1 direction) or in the backward conveyance direction (Y2 direction). The suction fan 107 is rotated by a motor outside the diagram, and sucks air from a plurality of suction holes (not illustrated) formed in the conveyance belt 106 as well as discharging the sucked air from a discharge port 109 as a discharge part of the conveyance unit 104. The print medium 103 is sucked to the surface (surface facing the printing part 110) of the conveyance belt 106 by the suction of air from the suction holes. In doing so, the conveyance belt 106 moves in the forward direction or in the backward direction together with the conveyance belt 106.

In the print part 110, an inkjet type print head 120 as a printing unit is detachably equipped in a position facing a traveling path of the conveyance belt 106. In the print head 120, the plurality of ejection ports capable of ejecting print liquid (hereinafter also referred to as ink) toward the print medium conveyed by the conveyance belt 106 are formed. Each of the ejection ports is supplied with the ink from a common liquid chamber of the print head 120, and the ink is ejected from the ejection port by driving an ejection energy generating element arranged inside the ejection port. In addition, a surface 120*a* of the print head 120 where the ejection ports are formed is referred to as an ejection port surface. Also, as the ejection energy generating element, an element such as an electrothermal conversion element (heater) or an electromechanical conversion element (piezo element) is known. The electrothermal conversion element generates heat upon receipt of electric energy, bubbles ink inside an ejection port by the heat, and ejects the ink from the ejection port by utilizing a variation in pressure caused by the bubbling.

In the ejection port surface 120*a* of the print head 120, the plurality of ejection ports are arranged along a direction intersecting with (in the present embodiment, a direction (X direction) orthogonal to) the conveyance direction (Y direction), and the ejection ports format least one ejection port array. The print head 120 in the present embodiment is a full line type print head, in which the ejection port array having length corresponding to the width of the print medium 103 used is formed.

When performing a print operation, the ejection ports of the print head 120 are in an open state of being exposed to the air. At this time, in a situation where ink droplets are ejected from the ejection ports within a certain period of time by the print operation or the like, the ink inside the ejection ports are frequently refreshed to keep the ink in a state suitable for ejection. On the other hand, when stopping the print operation to perform a below-described post-process after the start of the print operation, a solvent of the print liquid inside the print head 120 may be evaporated from the ejection ports in the open state, and thickening, solidification, or the like of the print liquid may occur to reduce ejection performance of the ejection ports.

For this reason, in the present embodiment, in order to reduce the thickening or solidification of the ink inside the print head 120, damage to the ejection port surface, and the like, a capping mechanism (capping unit) as an open/close mechanism that can selectively perform a closing or opening operation of the ejection port surface 102*a* is provided.

The capping mechanism. 130 in the present embodiment includes: a head moving mechanism 140 adapted to move the print head 120 in a vertical direction (Z direction); and a cap moving mechanism 150 adapted to move a capping member 151 capable of covering the ejection port surface of the print head 120. The head moving mechanism 140 includes: a rack 141 that is provided on a lateral surface of the printing part 110 including the print head 120; a pinion gear 142 that gears with the rack 141; and a head motor 143 that rotates the pinion gear 142. In the present embodiment, by driving the head motor 143 to rotate the pinion gear 142, the print head 120 is moved in the vertical direction (Z direction) together with the printing part 110 provided with the rack 141.

The cap moving mechanism 150 includes: the capping member 151; a rack 152 that is included in part of the capping member 151; a pinion gear 153 that gears with the rack 152; and a cap motor 154 that rotates the pinion gear 153. In the present embodiment, by driving the cap motor 154 to rotate the pinion gear 153, the capping member 151 is moved along a direction (in the present embodiment, the Y direction) intersecting with the Z direction together with the rack 152 gearing with the pinion gear 153.

By operating the head moving mechanism 140 and the cap moving mechanism 150 in accordance with a predetermined procedure, the ejection port surface 120*a* can be brought into a close state or the open state by the capping member 151. FIG. 1 illustrates a state where printing is performed on the print medium 103 by the print head 120*a*, i.e., a state where the capping member 151 is held in a position (withdrawal position) to open the ejection port surface 120*a*. In the case of performing the closing operation that closes the ejection port surface 120*a* of the print head 120, first, the print head 120 is moved above the capping member 151 by driving the head motor 143. After that, by driving the cap motor 154, the capping member 151 is moved in the Y1 direction and made to face the ejection port surface 120*a* through a predetermined gap. Subsequently, the print head 120 is moved downward by driving the head motor 143, and brought into contact with the capping member 151. In doing so, the ejection port surface 120*a* is closed by the capping member 151, and communicative connection with the air is blocked. In addition, by operating the head moving mechanism 140 and the cap moving mechanism in accordance with a procedure opposite to the above-described procedure, the ejection port surface 120*a* can be switched from the close state to the open state. The switching operation from the close state to the open state is hereinafter referred to as the opening operation. It is assumed that in an opening completion state where the opening operation is completed, the print head 120 is in a state of being able to print on the label 103B conveyed to a print position. In the present invention, the opening completion state refers to a state where the print head 120 can print on the label 103B.

Also, the printing apparatus 100 includes a fore end detecting sensor 111 adapted to detect a fore end position of each label of the print medium in order to determine print timing for the print medium 103. The fore end detecting sensor 111 detects the fore end of each of the plurality of labels 103B, which are affixed on the mount 103A of the print sheet 103 conveyed in the forward conveyance direction (Y1 direction), at an upstream position of the position to print the label 130B by the print head 120 in the Y1 direction. The fore end detecting sensor 111 includes any or both of a reflection type sensor and a transmission type sensor, and on the basis of the difference in transmittance between the mount and a label, can detect the fore end by detecting a received light amount. In addition, in the case where on each of the labels 103B of the print medium 103, a fore end detecting mark is formed, on the basis of the difference in reflectance between the mark and the rest of the label, the fore end detecting sensor 111 can also detect the fore end of the print medium by detecting a received light amount. Further, a rotary shaft of the guide roller 108A provided in the conveyance unit 104 is provided with a well-known rotary encoder that rotates in synchronization with the rotary shaft, and the rotary encoder functions as a conveyance position detecting unit adapted to detect a conveyance position of the print medium 103 together with the fore end detecting sensor 111.

On the downstream side of the position to print the labels 130B by the print head 120 in the Y1 direction, the peeling part 112 for peeling off a printed label 103B printed in the printing part 110 from the mount 103A is provided. The peeling part is a post-processing part in the present invention, where a predetermined post-process is performed. The peeling part 112 positions the printed label 103B in a peeling position to peel off the printed label 103B from the mount 103A by in different directions, guiding the printed label 103B and the mount 103A of the print medium 103 conveyed in the forward conveyance direction (Y1 direction) by the conveyance unit 104. At this time, a part of the label 103B is peeled off from the mount 103A, and the rest of the label 103B remains affixed on the mount 103A. A label detecting sensor 113 detects that the peeled label 103B has been taken out of the peeling part 112 by an operator. When it is detected that the label has been taken out, the conveyance unit 104 conveys the continuous sheet 103 to a print start position in the backward conveyance direction (Y2 direction) opposite to the forward conveyance direction (Y1 direction), and then printing is performed on a next print target label (e.g., a label positioned closest to the label taken out). Note that the print start position refers to a position determined such that the fore end of a print target label is positioned on the upstream side of the fore end detecting sensor 111 in the Y1 direction. In the present embodiment, a detecting target label is a label next to the label taken out. However, depending on the length of a conveyance path from the printing part 110 to the peeling part of the printing apparatus 100, or the length of a label to be used in the Y direction, another label positioned further upstream side of the label next to the label taken out may serve as a print target.

Figure 2:
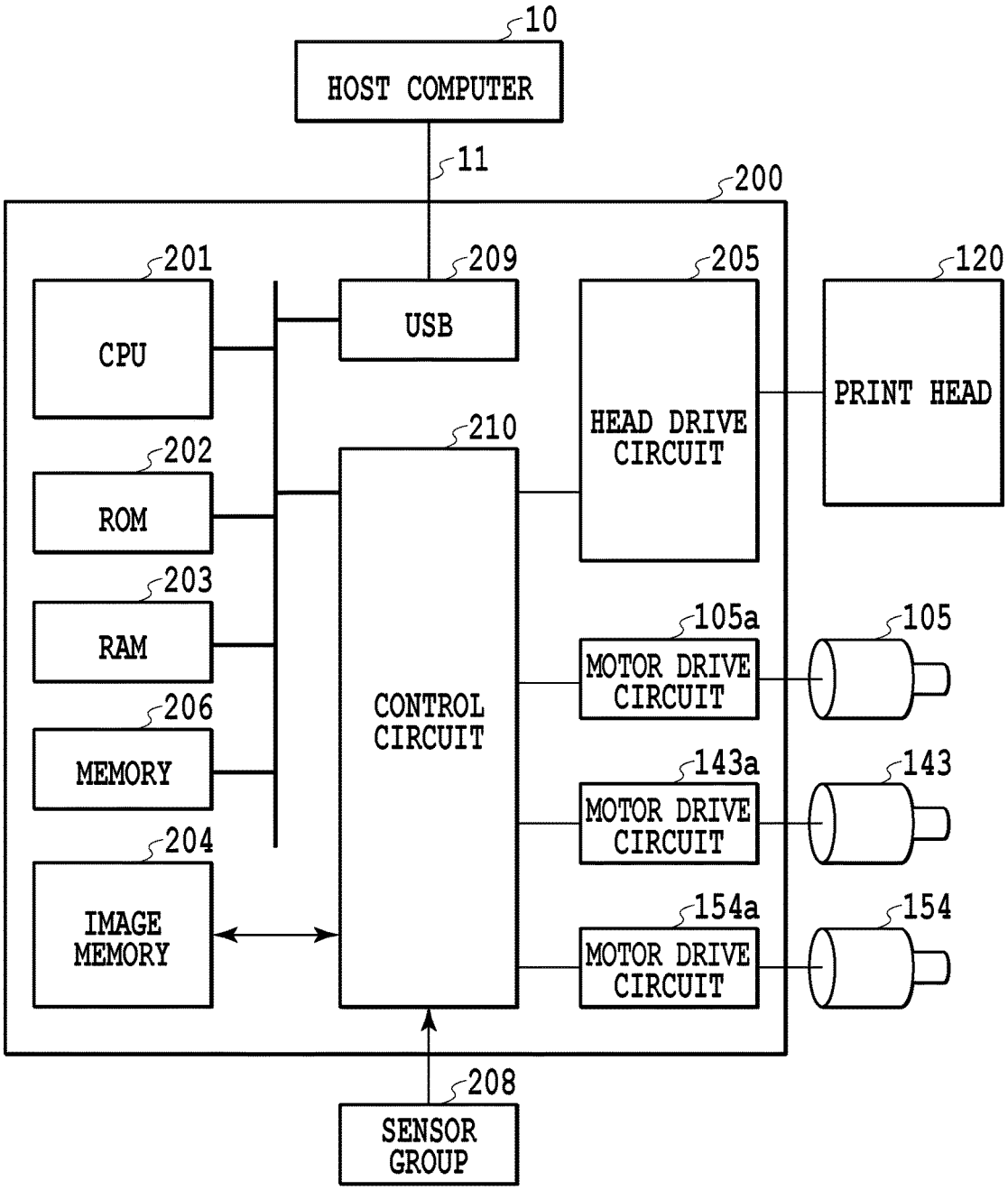
FIG. 2 is a block diagram illustrating a schematic configuration of a control system in the embodiments of the present invention.

FIG. 2 is a block diagram illustrating a schematic configuration of a control system 200 of the printing apparatus 100 in the present embodiment. The control system 200 includes a central processing unit (CPU) 201 as a control part. The CPU 201 executes a control program stored in a nonvolatile memory (ROM) 202 and functions as the control part adapted to control respective peripheral devices. Also, the CPU 201 is connected to an RAM 203 used as a work area for various types of data processing and a receive buffer, and an image memory 204 as a development part adapted to develop print data on an image to be printed. The CPU 201 is also connected to a memory 206 that stores the below-described acquisition time T, the below-described estimated time Tc, and the like. Further, the CPU 201 is connected with a head drive circuit 205 that drives the print head 120, and motor drive circuits corresponding to various types of motors provided in the printing apparatus 100. FIG. 2 illustrates motor drive circuits 105*a*, 143*a*, and 154*a* respectively for the above-described conveyance motor 105, head motor 143, and cap motor 154; however, the CPU 201 also controls the other motor drive circuits for motors provided in the printing apparatus 100. As the motors, various types of motors that produce driving force for performing a cleaning operation of the printing apparatus print head, print operation, cutting operation for a print medium, and other operations are provided, and the motor drive circuits for the respective motors are also controlled by the CPU 201. Still further, the CPU 201 is connected with a sensor group 208 that detects the print medium 103, and operation states of respective parts inside the apparatus. The sensor group 208 also includes sensors such as the above-described fore end detecting sensor 111, label detecting sensor 113, and the rotary encoder.

Figure 3:
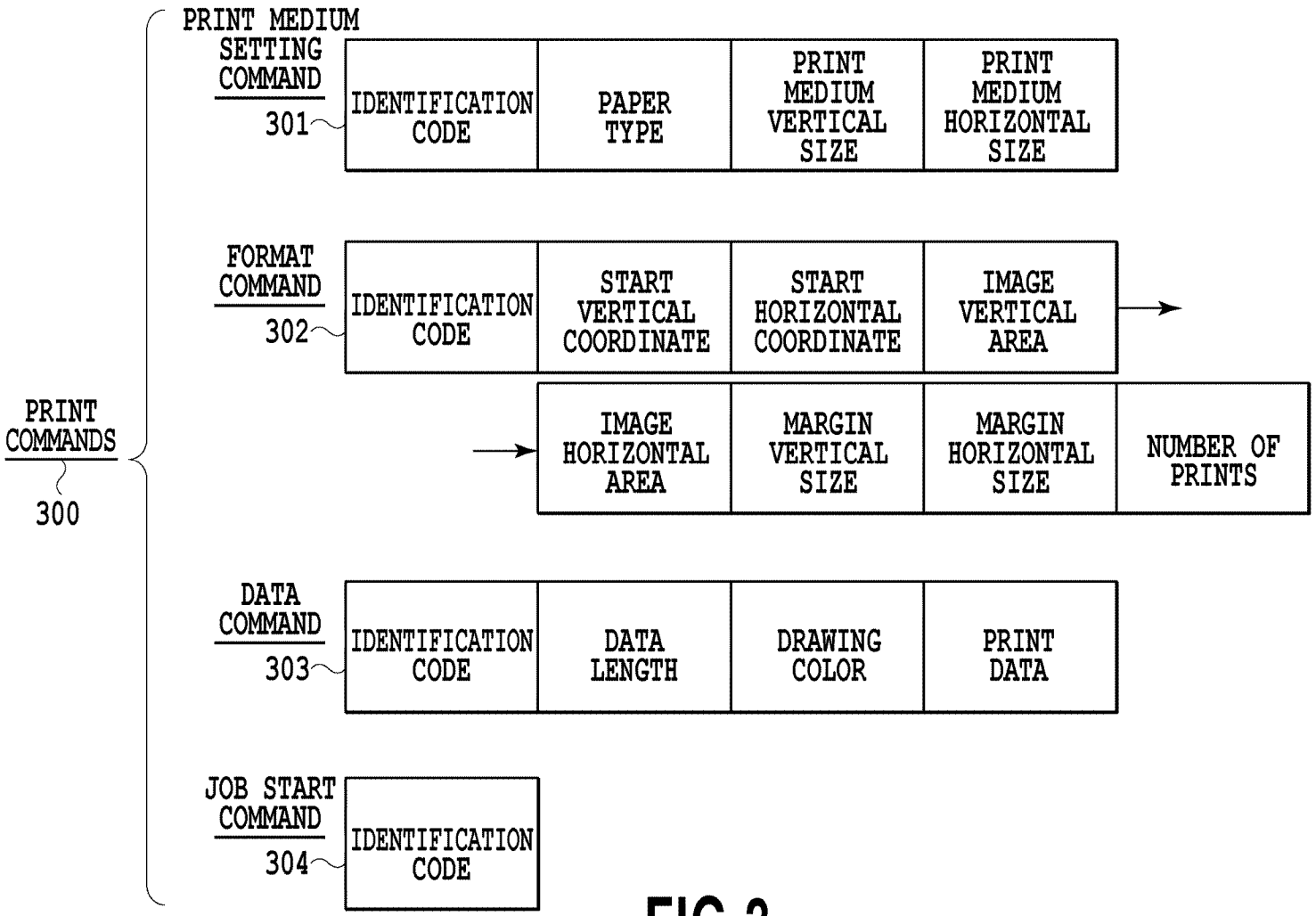
FIG. 3 is an explanatory diagram illustrating various types of commands transmitted in the printing system illustrated in FIG. 1.

FIG. 3 is a diagram illustrating various types of commands transmitted in the printing system of the present embodiment. The various types of commands illustrated here are transmitted from the host computer 10 to the printing apparatus 100 through the printer cable 11 in the present embodiment. In FIG. 3, 300 represents the print commands. The print commands 300 includes commands such as: a print medium setting command 301 that notifies pieces of information on a print medium, such as a type and size; a format command 302 that specifies pieces of information such as a print area; a data command 303 that notifies information of print data on a print image; and a job start command 304. The printing apparatus 100 performs a print operation on the basis of the print commands 300 transmitted from the host computer 10.

Figure 4:
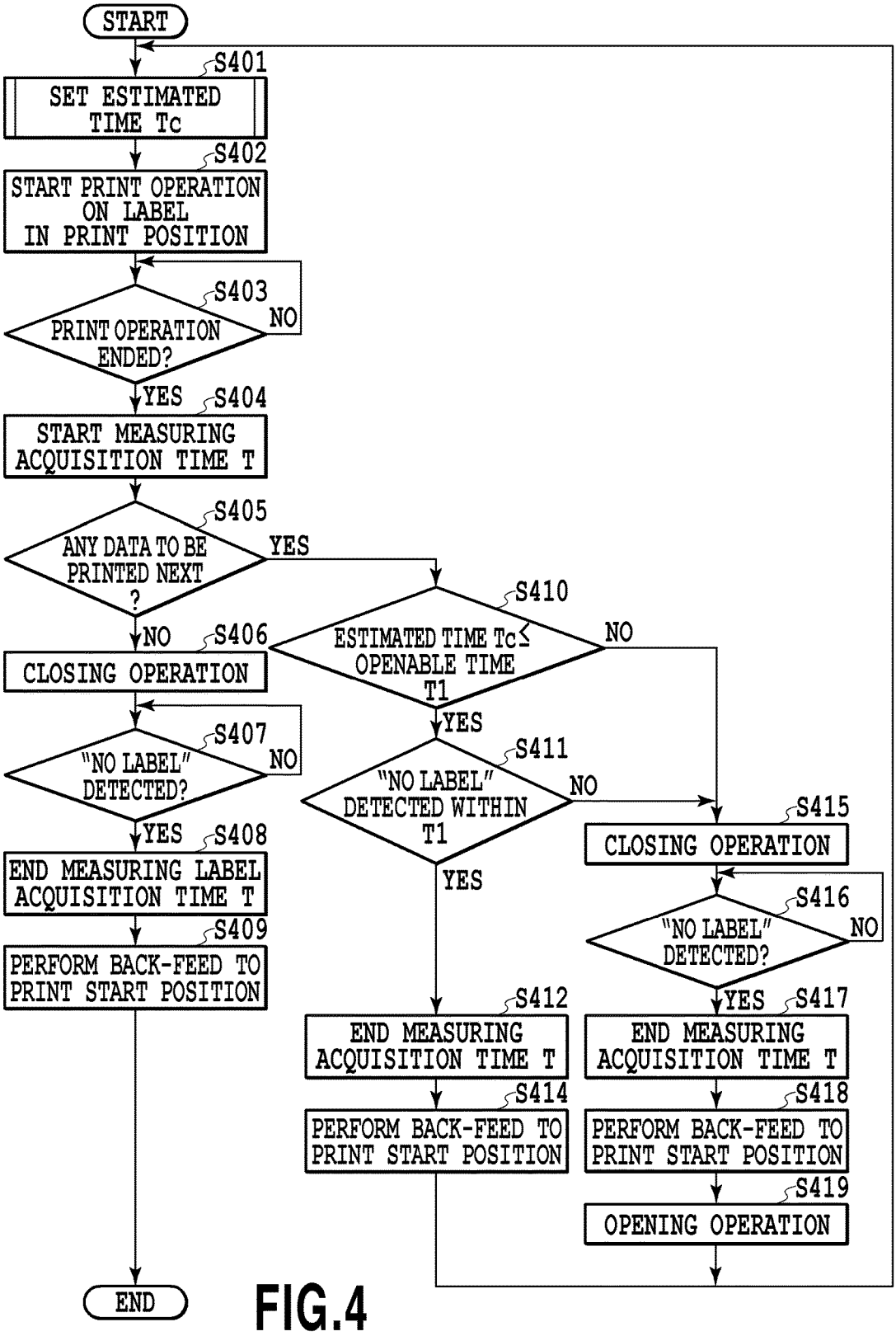
FIG. 4 is a flowchart illustrating an overall control operation in the first embodiment.

FIG. 4 is a flowchart illustrating an overall control operation in the present embodiment. A determination process and a control process illustrated in FIG. 4 are performed by the CPU 201. In S401, the CPU 201 sets an estimated elapsed time from when a print operation on a label 103B is ended in the printing part 110 to when the printed label 103B is peeled off from the mount 103A in the peeling part 112 and taken out by an operator. The elapsed time set by the estimation setting is defined as an estimated time Tc. A method for setting the estimated time Tc will be described later on the basis of FIG. 5.

In S402, in the case where the ejection port surface 120*a* of the print head 120 is closed by the capping member 151, the CPU 201 makes the capping member 151 perform the opening operation, whereas in the case where the ejection port surface 120*a* is opened, while keeping the open state and conveying the print medium 103 in the forward conveyance direction (Y1 direction) by the conveyance unit 104 to thereby convey a label positioned in the print start position to the print position, the CPU 201 makes the printing part 110 eject the ink toward the label 103B conveyed to the print position and starts image printing. In S403, the CPU 201 determines whether or not the print medium 103 has been conveyed to a print end position where the print operation on the label 103B is ended. In S404, the CPU 201 starts measuring an acquisition time T that is an elapsed time from when the print operation on the label 103B in the print position is ended to when the printed label 103B is peeled off from the mount 103A in the peeling part 112, and taken out of the apparatus by the operator. Note that differently from the above-described estimated time calculated in S401, the acquisition time T refers to a measured time obtained by actually measuring the elapsed time from when the print operation on the label is ended to when the label is taken out of the apparatus. After that, in S405, the CPU 201 determines whether or not print data to be printed next is present (whether or not the RAM 203 has print data to be printed next). In the case where the CPU 201 here determines that print data to be printed next is not present (NO in S405), the flow proceeds to S406, where the above-described closing operation that closes the ejection port surface 120*a* of the print head 120 by the capping member 151 of the capping mechanism 130 is performed.

In S407, the CPU 201 determines on the basis of a detection signal from the label detecting sensor 113 whether or not the label 103B sent to the peeling part 112 and peeled off from the mount 103A is taken out by the operator to bring the mount 103A into a non-label state. In the case where the CPU 201 determines that the mount 103A is in the non-label state (YES in S407), the CPU 201 ends in S408 the above-described measurement operation of the label acquisition time T started in S404, sets the elapsed time from the start of the measurement to the end of the measurement as the acquisition time T, and stores the acquisition time T in the memory 206 relating the acquisition time T to which ordinal number the print operation in S402 (last performed print operation) corresponds to. In S409, the CPU 201 conveys the print medium 103 in the backward conveyance direction (Y2 direction) to move a label 103B to be printed next to the above-described print start position, and waits to receive next print data.

On the other hand, in S405, in the case where the CPU 201 determines that print data to be printed next is present (YES in S405), the flow proceeds to S410 without performing the closing operation in S408. In S410, the CPU 201 determines whether or not the above-described estimated time Tc (estimated time Tc that is stored in the memory 206 and corresponds to the print operation in S402 (last performed print operation)) is equal to or less than the below-described openable time T1. In the case where the estimated time Tc is equal to or less than the openable time T1, the CPU 201 waits for the label 103B peeled off in the peeling part 112 to be taken out by the operator while keeping the ejection ports of the print head 120 in the open state. Note that the openable time is a time obtained by subtracting a time necessary for the above-described closing operation and a time corresponding to a predetermined margin from the maximum value (maximum open time) of a time for which the ejection port surface 120*a* can be continuously opened without reducing print quality by the print head 120. In addition, the openable time may be one obtained without subtracting the time corresponding to the predetermined margin.

In S411, the CPU 201 determines whether or not an elapsed time from when the print operation on the label 103B is ended to when the label detecting sensor 113 detects "no label" is equal to or less than the openable time (T1). In the case where the label detecting sensor 113 detects "no label" within the openable time T1, the CPU 201 ends the above-described measurement of the acquisition time T started in S404, then sets the elapsed time from the start of the measurement to the end of the measurement as the acquisition time T, and stores the acquisition time T in the memory 206 relating the acquisition time to which ordinal number the print operation in S402 (last performed print operation) corresponds to. After that, in S414, the CPU 201 conveys the print medium 103 in the backward conveyance direction Y2, i.e., performs so-called back-feed in order to print the next label 103B, and the flow proceeds to S401 again.

In the case where the CPU 201 determines in S410 that the estimated time Tc is longer than the openable time T1 (NO in S410), or in the case where in S411, the label detecting sensor 113 does not detect "no label" within the openable time T1 (NO in S411), the flow proceeds to S415. In S415, the CPU 201 performs the closing operation that covers the ejection port surface 120*a* of the print head 120 by the capping member, and thereby suppresses thickening or solidification of the ink as well as protecting the ejection port surface 120*a*. When "no label" is detected in S416, the flow proceeds to S417, and the CPU 201 ends the measurement of the acquisition time T started in S404. Subsequently, in S418, the CPU 201 performs the back-feed that conveys the print medium 103 to the print start position. After that, in S419, the CPU 201 performs the opening operation of the ejection port surface 120*a* of the print head 120 to bring the print head 120 into a printable state.

Note that in the present embodiment, in the case where after the end of the print operation on some label, there is print data to be printed next, and the estimated time Tc is equal to or less than T1, the CPU 201 prevents the closing operation from being performed by the capping member 151; however, the present invention is not limited to this. Even in the case where after the end of the print operation on some label, there is print data to be printed next, the CPU 201 may make the capping member 151 perform the closing operation.

Figure 5:
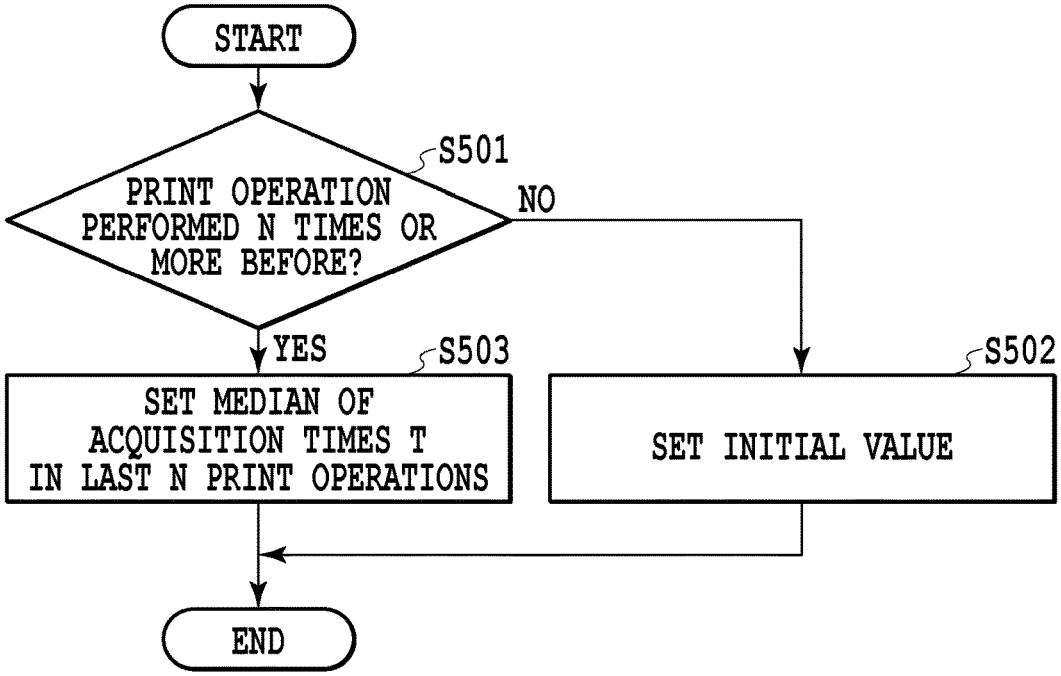
FIG. 5 is a flowchart illustrating an estimated time calculation process performed in the first or second embodiment.

FIG. 5 is a flowchart illustrating a calculation process of the estimated time Tc performed in the present embodiment. The flowchart illustrated in FIG. 5 is performed by the CPU 201.

In S501, the CPU 201 determines on the basis of information stored in the memory 206 whether or not the print operation has been performed before N or more times (print operation performed on N or more labels). In the case where the CPU 201 determines that the print operation has not been performed in the past N or more times (on N or more labels), in S502, the CPU 502 sets a predetermined initial value as an estimated time Tc, and stores the estimated time Tc in the memory 206 relating the estimated time Tc to which ordinal number (which ordinal label) the print operation to be performed from now corresponds to. Also, in the case where N≥1, and the CPU 201 determines that one or more labels have been printed, the CPU 201 uses acquisition times in label print operations before the previous time to set the estimated time Tc. In S501, in the case where the print operation has been performed on N or more labels 103B in the past, the CPU 201 sets, as the estimated time Tc, a median of acquisition times T in the N print operations performed just before the print operation to be performed from now, and stores the estimated time Tc in the memory 206 relating the estimated time Tc to which ordinal number (which ordinal label) the print operation to be performed from now corresponds to.

Figures 6A, 6B:
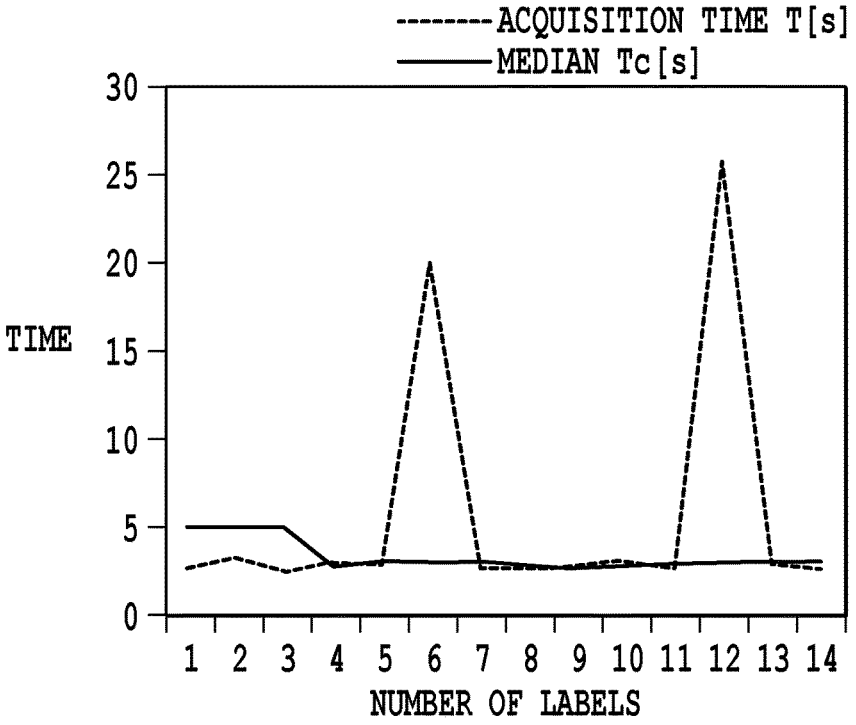
FIGS. 6A and 6B are diagrams illustrating an example of a result of calculating an estimated time Tc from a label acquisition time T in the first or second embodiment.
Figures 7A, 7B:
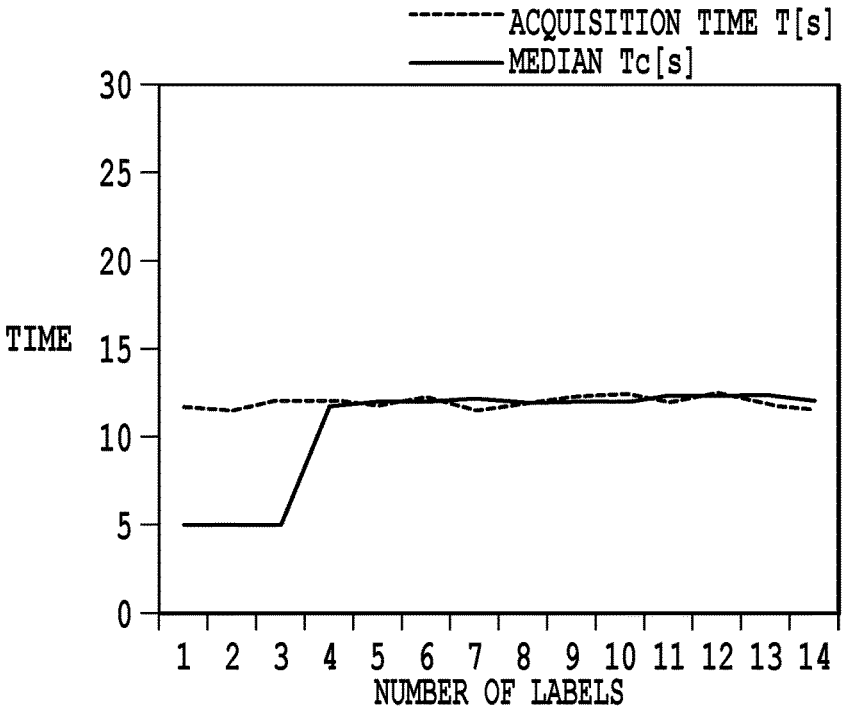
FIGS. 7A and 7B are diagrams illustrating an example of a result of calculating an estimated time Tc from a label acquisition time T in the first or second embodiment.

FIGS. 6A and 6B, and FIGS. 7A and 7B are respectively diagrams illustrating results of calculating estimated times Tc from label acquisition times T. FIGS. 6A and 7A are tables illustrating pieces of information stored in the memory 206 in which the numbers of past printed labels, the acquisition times T, and the medians of the acquisition times are related to one another. FIGS. 6B and 7B are graphs illustrating the numbers of past printed labels, acquisition times T, and medians of the acquisition times. In addition, FIGS. 6A and 6B correspond to each other, and FIGS. 7A and 7B correspond to each other.

FIGS. 6A and 6B and FIGS. 7A and 7B respectively illustrate the cases where 14 labels were printed under the conditions of N=3, initial value=5 seconds, and openable time T1=4 seconds, as an example. Also, it is assumed that the sum of the time necessary for the closing operation that switches the ejection port surface of the print head from the open state to the close state and the time necessary for the opening operation that switches the ejection port surface from the close state to the open state (close and open time) is 5 seconds.

In the case of the example illustrated in FIGS. 6A and 6B, an estimated time Tc set before performing the print operation on the 14th label is, as illustrated in the flow in FIG. 5, Tc=3.1, which is determined from the medians of the 11th, 12th, and 13th print operations performed just before (since the longest time is 25.6 seconds and the shortest time is 2.8 seconds, the median is 3.1 seconds), and the relationship between the openable time T1 (=4 seconds) and the estimated time Tc meets T1≥Tc. Note that regarding (N+1)-th or subsequent labels, except for the 6th and 12th labels, the opening/closing operation by the capping member 151 is not performed after performing the print operation on a label. For this reason, when making a comparison between the case of performing the closing/opening operation on the basis of the control operation of the present embodiment and the case of performing the closing/opening operation for each label, a time necessary for the whole of the print operations is shortened.

On the other hand, in the case of the example illustrated in FIGS. 7A and 7B, an estimated time Tc set before performing the print operation on the 14th label is Tc=12.2 seconds, which is determined from the medians, and the relationship between the openable time T1 (4 seconds) and the estimated time Tc meets T1<Tc. For this reason, immediately after the end of the label print operation, the closing operation by the capping member is performed.

That is, in the case where the estimated time Tc is equal to or less than the openable time T1, by performing the control operation of the present embodiment, a time necessary to print on a next label can be shortened to minimize a reduction in productivity while preventing a reduction in print quality.

Note that each of FIGS. 5 to 7A and 7B illustrates the example where to set the estimated time Tc, the medians are used; however, the estimated time Tc can also be calculated by a method using average values, or another method, and a method for calculating the estimated time can be arbitrarily set. In addition, a sampling number N used to calculate the estimated time Tc is set to a natural number equal to or more than 1, and can be appropriately set in consideration of a variation in acquisition time.

Second Embodiment

Next, a second embodiment of the present invention is described. In the following, points of difference between the above-described first embodiment and the second embodiment are described. It is assumed that this second embodiment also has the configuration illustrated in FIGS. 1 and 2 as with the first embodiment. In the first embodiment, the CPU 201 determines whether or not to perform the closing operation. On the other hand, in this second embodiment, after performing a closing operation on the print head 120, the CPU 201 starts an opening operation of the ejection port surface 120*a* first depending on an estimated time Tc before the label detecting unit 113 detects that a label is taken out of the peeling part 112. Note that in this second embodiment, the CPU 201 parallel performs an operation of switching the ejection port surface 120*a* of the print head from a close state to an open state by the capping mechanism 130 and an operation of conveying a label to be printed next backward. After ending the print operation on the label by the print head 120, the CPU 201 conveys backward the print medium until a label to be printed next reaches the print start position immediately after the label detecting sensor 113 has detected "no label". This is based on the premise that a time necessary for the capping mechanism 130 to switch the ejection port surface 120*a* of the print head from the close state to an opening completion state is longer than a time necessary to convey the print medium backward until the label to be printed next reaches the print start position after the detection of "no label".

Figures 8, 8A:
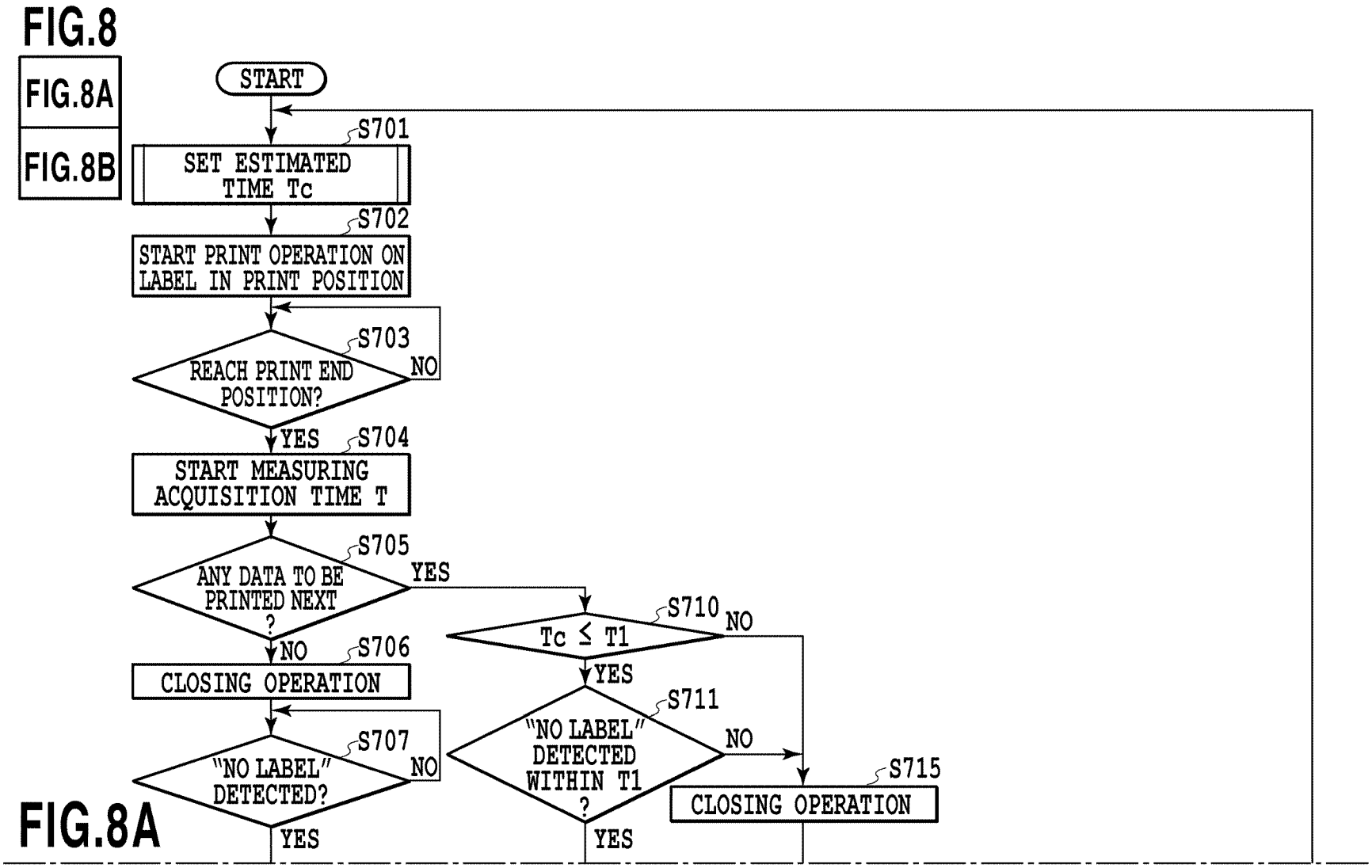
FIG. 8 is a diagram showing a relationship between FIG. 8A and FIG. 8B.
FIGS. 8A and 8B are flowcharts illustrating an overall control operation in the second embodiment of the present invention.
Figure 8B:
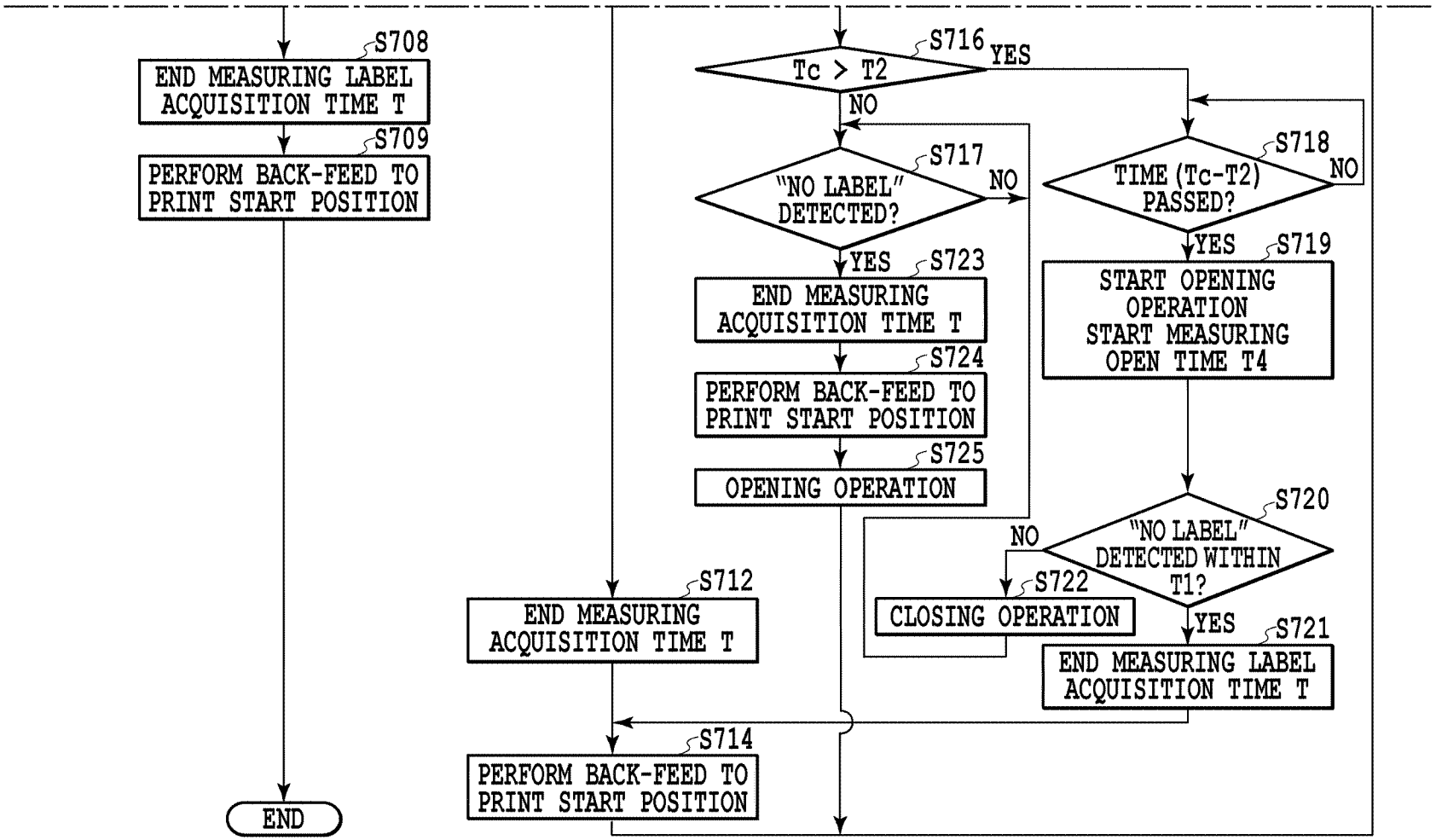

FIGS. 8A and 8B are flowcharts illustrating an overall control operation in the second embodiment of the present invention, and FIG. 8 is a diagram showing a relationship between FIG. 8A and FIG. 8B. The flowcharts illustrated in FIGS. 8A and 8B are performed by the CPU 201. Processing steps in S701 to 715, 717, 723, 724, and 725 illustrated in FIGS. 8A and 8B are the same as those in S401 to 415, 416, 417, 418, and 419 in the first embodiment, and therefore description of them is omitted.

In Step S710, in the case where the CPU 201 determines that an estimated time Tc (estimated time Tc that is stored in the memory 206 and corresponds to a print operation in S702 (last performed print operation) is longer than an openable time T1 (NO in S710), the flow proceeds to S715, and the CPU 201 makes the capping mechanism 130 bring the ejection port surface 120*a* into the close state. Then, the CPU 201 determines in S716 whether or not the estimated time Tc exceeds a print preparation time (exceeds T2). Note that the print preparation time T2 corresponds to the sum of a time necessary for the closing operation that switches the ejection port surface of the print head from the opening completion state to the close state, a time necessary for the opening operation that switches the ejection port surface from the close state to the opening completion state, and a time corresponding to a predetermined margin. The print preparation time T2 may not include the time corresponding to the predetermined margin.

In the case where the estimated time Tc is longer than the print preparation time T2 (YES in S716), the flow proceeds to S718, where the CPU 201 determines whether or not a time (the estimated time Tc−the print preparation time T2) has passed after the end of the print operation on a label 103B. In S719, when the time (Tc−T2) has just passed after the end of the print operation, the CPU 201 starts the opening operation by the print capping mechanism 130, i.e., a print preparation operation making it possible for the print head 120 to perform printing, before an expected operation of taking out the label, as well as starting the measurement of an open time T4. Subsequently, the CPU 201 determines in S720 whether or not the label detecting sensor 113 has detected "no label" within the openable time T1 after the start of the measurement of the open time T4 in S719. In the case where "no label" has been detected here within the openable time T1, in S721, the CPU 201 ends the measurement of the open time T4, as well as ending the measurement of an acquisition time T started in S704 to set an elapsed time from the start of the measurement to the end of the measurement as the acquisition time T, and storing the acquisition time T in the memory 206 relating the acquisition time T to which ordinal number the print operation in S702 (last performed print operation) corresponds to. Then, in S714, the CPU 201 performs the back-feed of the print medium 103, and moves a label to be printed next to the print start position. After that, the flow proceeds to S701, and the CPU 201 sets an estimated time and starts the print operation on the label in the print position. On the other hand, in S720, in the case where "no label" has not been detected within the time T1, the flow proceeds to S722, where the CPU 201 ends the measurement of the open time T4, as well as making the capping mechanism 130 perform the closing operation. Subsequently, the flow proceeds to S717, where it is determined that "no label" has been detected, the CPU 201 performs the processing steps in S712 to S714, S723, and S701 described before, and in S702 printing on the label in the print position is performed.

As described above, in this second embodiment, in the case where the time necessary for the opening operation by the capping mechanism 130 is longer than the time necessary for the back-feed of the print medium 103, the print preparation operation (opening operation) of the capping mechanism 130 is performed first in accordance with the estimated time Tc. This makes it possible to reduce a time necessary before printing on a next label to suppress a reduction in productivity while lessening a reduction in print quality due to thickening, solidification, or the like of ink in the print head.

Other Embodiments

In the above-described first or second embodiment, the printing apparatus using the print medium of which the mount is affixed with the labels is taken as an example to give the description; however, the present invention is also applicable to a printing apparatus that performs a print operation on a print medium other than the print medium used in each of the above-described embodiments. Also, the present invention is not limited to the printing apparatus that as the post-process, performs the peeling operation that peels off a printed label 103B from the mount 103A as in the above-described first or second embodiments. That is, in the present invention, the configuration of the post-process is not limited to that described in each of the above-described embodiments as long as the post-process is performed after stopping a print operation. For example, in a printing apparatus by which as a post-process, an operator performs a cutting process that at predetermined lengths, cuts a print medium as a continuous sheet discharged to a discharge part, a print operation during the post-process is stopped. For this reason, applying the present invention can lessen a reduction in print quality due to the deterioration of ink during the post-process. In this case, the discharge part serves as a site where the post-process is performed. In other words, the discharge part corresponds to the post-processing part of the present invention.

Also, in each of the above-described embodiments, the capping mechanism that closes and opens the ejection port surface of the print head is configured to include the head moving mechanism adapted to move the print head and the cap moving mechanism adapted to move the capping member. For this reason, a time necessary for each of the closing operation and the opening operation is the sum of a head moving time and a capping member moving time. On the other hand, the capping mechanism can also be configured differently from the configuration in each of the above-described embodiments. For example, the present invention can also be configured to perform the closing operation or the opening operation by moving only a print head with respect to a capping member placed in a fixed position. This makes it possible to simplify each of the closing operation and the opening operation, as well as shortening the time necessary for each of the operations.

Further, in each of the above-described embodiments, the printing apparatus that performs printing using the full line type inkjet print head while continuously conveying the print medium is taken as an example to give the description. However, the present invention is not limited to the printing apparatus having such a configuration, but is also applicable to a printing apparatus having another configuration. That is, the present invention is applicable to a serial type printing apparatus that intermittently conveys a print medium along a conveyance direction, as well as ejecting print liquid to perform a print operation while moving a print head in a direction orthogonal to the conveyance direction when the print medium is stopped.

Still further, the present invention is, without limitation to the printing apparatus that prints on a continuous sheet, also applicable to a printing apparatus that sequentially prints on a cut sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-064375, filed Mar. 26, 2014, which is hereby incorporated by reference wherein in its entirety.

What is claimed is:

1. A printing apparatus comprising:

a printing unit configured to print on a print medium including a mount and a plurality of labels affixed on the mount in a peelable manner, wherein the printing unit is configured to print by ejecting print liquid from an ejection port;

an open/close unit configured to move to a closing position and an opening position wherein the open/close unit covers the ejection port at the closing position and uncovers the ejection port at the opening position;

a conveyance unit configured to convey a printing medium printed by the printing unit to a post-process part where the printed label is held in a state in which a part of the label is peeled off from the mount;

a detecting unit configured to detect that the label of which the part is peeled off from the mount is taken out from the mount; and a control unit configured to cause the open/close unit to move to the closing position in response to the state where the print medium printed is stopped at the post-process part and to cause the open/close unit to move to the opening position in response to a detection result of the detecting unit.

2. The printing apparatus according to claim 1, wherein the control unit controls the open/close unit so as to cause the open/close unit to move to the closing position when the print operation is not performed.

3. The printing apparatus according to claim 1, further comprising an estimation unit configured to calculate an estimated time from when one print operation by the printing unit is ended to when a next print operation by the printing unit is enabled, wherein the control unit controls the open/close unit in accordance with the estimated time.

4. The printing apparatus according to claim 3, wherein the estimation unit sets the estimated time to a predetermined time in a case where no print operation has been performed before.

5. The printing apparatus according to claim 3, wherein the estimation unit sets the estimated time on a basis of at least one measurement time from when one print operation by the printing unit is ended to when a next print operation by the printing unit is enabled.

6. The printing apparatus according to claim 3, wherein the estimation unit sets the estimated time on a basis of a median or an average of one or more measurement times from when one print operation by the printing unit is ended to when a next print operation by the printing unit is enabled.

7. The printing apparatus according to claim 3, wherein the open/close unit performs an operation for bringing the ejection port into a close state as a closing operation, and performs an operation for bringing the ejection port into an open state as an opening operation, the control unit makes a comparison between an openable time obtained by subtracting a time necessary for the closing operation from a maximum open time that has a maximum value of a time while the ejection port of the printing unit can be continuously opened and the estimated time, in a case where the estimated time is equal to or less than the openable time, prevents the closing operation and a opening operation from being performed during the openable time, and in a case where the estimated time is longer than the openable time, performs the closing operation after the end of the print operation, and before the next print operation by the printing unit, performs the opening operation.

8. The printing apparatus according to claim 7, further comprising a conveyance unit configured to be capable of convey the print medium in a forward conveyance direction and in a backward conveyance direction that is a direction opposite to the forward conveyance direction.

9. The printing apparatus according to claim 8, wherein the control unit compares a print preparation time that is a sum of the time necessary for the closing operation and the time necessary for the opening operation, the estimated time, and a backward conveyance time necessary to convey the print medium in the backward conveyance direction in order to start the next print operation by the printing unit with one another, and in a case where the estimated time is equal to or more than the print preparation time, and the time necessary for the opening operation is longer than the backward conveyance time, performs the closing operation after the end of the print operation, and when the print preparation time has just passed after the end of the print operation, performs the opening operation.

10. The printing apparatus according to claim 9, and using a print medium including a mount as a continuous sheet and a label affixed on the mount in a peelable manner, the printing apparatus further comprising:

a peeling unit configured to peel off the label printed by the printing unit from the mount while the conveyance unit conveying the print medium; and a label detecting unit configured to detect that the label peeled off by the peeling unit has been taken out of the apparatus.

11. The printing apparatus according to claim 10, wherein the estimation unit calculates the estimated time on a basis of a time from when the print operation on the label by the printing unit is ended to when the label detecting unit detects that the label peeled off by the peeling unit has been taken out of the apparatus.

12. The printing apparatus according to claim 1, wherein the control unit causes the printing unit to start printing on a printing medium according to the detection result of the detecting unit.

13. A printing method comprising:

a printing step of printing on a print medium including a mount and a plurality of labels affixed on the mount in a peelable manner, wherein the printing step prints on the print medium by ejecting print liquid from an ejection port;

a conveyance step of conveying a printing medium printed by the printing step to a post-process part where the printed label is held in a state in which a part of the label is peeled off from the mount;

a close step of closing the ejection port in response to the state where the print medium printed is stopped at the post-process part;

a detecting step of detecting that the label of which the part is peeled off from the mount is taken out from the mount, and an open step of opening the ejection port in response to detecting result of the detecting step.

14. The printing apparatus according to claim 1, wherein the printing unit does not print on the printed print medium which has been subjected to the post-process by the post-process part.

* * * * *